US011339680B2

(12) United States Patent
Yoshida et al.

(10) Patent No.: US 11,339,680 B2
(45) Date of Patent: May 24, 2022

(54) RADIAL INFLOW TURBINE AND TURBOCHARGER

(71) Applicant: MITSUBISHI HEAVY INDUSTRIES ENGINE & TURBOCHARGER, LTD., Sagamihara (JP)

(72) Inventors: Toyotaka Yoshida, Tokyo (JP); Bipin Gupta, Tokyo (JP); Yosuke Dammoto, Sagamihara (JP); Yoji Akiyama, Sagamihara (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 16/967,663

(22) PCT Filed: Feb. 28, 2018

(86) PCT No.: PCT/JP2018/007575
§ 371 (c)(1),
(2) Date: Aug. 5, 2020

(87) PCT Pub. No.: WO2019/167181
PCT Pub. Date: Sep. 6, 2019

(65) Prior Publication Data

US 2021/0231027 A1 Jul. 29, 2021

(51) Int. Cl.
*F01D 17/16* (2006.01)
*F02B 37/24* (2006.01)
*F01D 9/02* (2006.01)

(52) U.S. Cl.
CPC ..... *F01D 17/165* (2013.01); *F02B 37/24* (2013.01); *F01D 9/026* (2013.01); *F05D 2220/40* (2013.01); *F05D 2240/128* (2013.01)

(58) Field of Classification Search
CPC ..... F01D 17/165; F01D 9/026; F01D 9/045; F02B 37/24; F05D 2220/40; F05D 2240/128; F05D 2240/127
See application file for complete search history.

(56) References Cited

U.S. PATENT DOCUMENTS 4,770,603 A * 9/1988 Engels ..... F01D 17/167 415/147
5,146,752 A 9/1992 Bruestle
(Continued)

FOREIGN PATENT DOCUMENTS

EP 0 433 560 A1 6/1991
EP 2 963 302 A1 1/2016
(Continued)

OTHER PUBLICATIONS

Extended European Search Report dated Dec. 22, 2020 issued to the corresponding European Application No. 18907677.1.
(Continued)

*Primary Examiner* — J. Todd Newton
(74) *Attorney, Agent, or Firm* — Birch, Stewart, Kolasch & Birch, LLP

(57) ABSTRACT

A radial inflow turbine includes a scroll flow passage, a turbine wheel disposed radially inward of the scroll flow passage, a plurality of variable nozzle vanes disposed on a flow passage extending from the scroll flow passage toward the turbine wheel, at a radial position between the scroll flow passage and the turbine wheel, a nozzle mount rotatably supporting each of the plurality of variable nozzle vanes, a nozzle plate arranged to face the nozzle mount and forming the flow passage with the nozzle mount, and a swirl generating member disposed, radially outward of the plurality of variable nozzle vanes, on the nozzle plate in a height range which is smaller than that of a vane height of each of the plurality of variable nozzle vanes. A position of an end part
(Continued)

of the swirl generating member on a side of the nozzle mount is farther away from the nozzle mount than a position of an end part of each of the plurality of variable nozzle vanes on the side of the nozzle mount in an axial direction.

11 Claims, 8 Drawing Sheets

(56) References Cited

U.S. PATENT DOCUMENTS

| | | | | |
|---|---|---|---|---|
| 8,418,460 | B2 * | 4/2013 | Ehrhard | F01D 17/165 60/602 |
| 2003/0039543 | A1 * | 2/2003 | Osako | F01D 17/165 415/150 |
| 2005/0260067 | A1 * | 11/2005 | Parker | F02C 6/12 415/160 |
| 2008/0193288 | A1 * | 8/2008 | Anschel | F04D 25/024 415/208.2 |
| 2013/0078083 | A1 * | 3/2013 | Barthelet | F02C 6/12 415/167 |
| 2016/0003046 | A1 | 1/2016 | Smith et al. | |
| 2017/0198593 | A1 * | 7/2017 | Yoshida | F01D 9/026 |
| 2018/0112551 | A1 * | 4/2018 | King | F01D 17/14 |
| 2020/0362721 | A1 * | 11/2020 | Gupta | F01D 17/16 |

FOREIGN PATENT DOCUMENTS

| | | | |
|---|---|---|---|
| JP | 1-66402 | U | 4/1989 |
| JP | 2002-129970 | A | 5/2002 |
| JP | 2011-106276 | A | 6/2011 |
| JP | 2016-148344 | A | 8/2016 |

OTHER PUBLICATIONS

Japanese Office Action, dated Jun. 1, 2021, for Japanese Application No. 2020-503173, with an English machine translation.

International Search Report issued in PCT/JP2018/007575 (PCT/ISA/210), dated Apr. 24, 2018.

Written Opinion of the International Searching Authority issued in PCT/JP2018/007575 (PCT/ISA/237), dated Apr. 24, 2018.

* cited by examiner

RADIAL INFLOW TURBINE AND TURBOCHARGER

TECHNICAL FIELD

The present invention relates to a radial inflow turbine and a turbocharger.

BACKGROUND

Conventionally, for example, in a turbocharger for an automobile, power of energy discharged from various engines is recovered, and energy, which is recovered from a working fluid of a medium/low temperature, high temperature, low pressure, or high pressure discharged from each of the engines, is converted into rotational power to be used for supercharging. Various turbines used for such power recovery of discharge energy are disclosed. For example, Patent Document 1 discloses a variable nozzle unit disposed between a turbine scroll flow passage and a turbine impeller in a turbine housing in a variable displacement turbocharger.

CITATION LIST

Patent Literature

Patent Document 1: JP2016-148344A

SUMMARY

Technical Problem

Meanwhile, in a radial inflow turbine including a variable nozzle vane described above, it is known that turbine efficiency may be decreased by so-called clearance flows passing through a gap between a nozzle mount and a nozzle plate, and an axial end surface of the variable nozzle vane in a low opening state. The nozzle mount and the nozzle plate form a flow passage extending from the scroll flow passage toward a turbine wheel. The variable nozzle vane is arranged between the nozzle mount and the nozzle plate. In this regard, Patent Document 1 described above does not disclose any specific measure against the decrease in turbine efficiency due to such clearance flows.

In view of the above, an object of at least one embodiment of the present invention is to suppress the decrease in turbine efficiency in the low opening state while suppressing an influence on a flow passage in a high opening state.

Solution to Problem (1) A radial inflow turbine according to at least one embodiment of the present invention is a radial inflow turbine including a scroll flow passage, a turbine wheel disposed radially inward of the scroll flow passage, a plurality of variable nozzle vanes disposed on a flow passage extending from the scroll flow passage toward the turbine wheel, at a radial position between the scroll flow passage and the turbine wheel, a nozzle mount rotatably supporting each of the plurality of variable nozzle vanes, a nozzle plate arranged to face the nozzle mount and forming the flow passage with the nozzle mount, and a swirl generating member disposed, radially outward of the plurality of variable nozzle vanes, on the nozzle plate in a height range which is smaller than that of a vane height of each of the plurality of variable nozzle vanes. A position of an end part of the swirl generating member on a side of the nozzle mount is farther away from the nozzle mount than a position of an end part of each of the plurality of variable nozzle vanes on the side of the nozzle mount in an axial direction.

As a result of intensive researches of the present inventors, it is found that in a radial inflow turbine including variable nozzle vanes, in particular, in a case in which each of the variable nozzle vanes is supported in a cantilever fashion via a corresponding one of rotating shafts, more clearance flows flow into a gap between the variable nozzle vane and the nozzle plate where the rotating shaft does not exist, as compared with a gap between the variable nozzle vane and the nozzle mount where the rotating shaft exists.

In this regard, with the above configuration (1), with the swirl generating member disposed on the nozzle plate radially outward, that is, upstream of the variable nozzle vanes, swirls are formed on the side of the nozzle plate in the flow passage radially inward, that is, downstream of the swirl generating member. With these swirls, it is possible to reduce a pressure difference between a pressure side and a suction side of each of the plurality of variable nozzle vanes. Thus, it is possible to effectively reduce the clearance flows passing through the gap between the nozzle plate and each of the plurality of variable nozzle vanes, making it possible to effectively suppress a decrease in turbine efficiency in a low opening state. Furthermore, since the position of the end part of the swirl generating member on the side of the nozzle mount is farther away from the nozzle mount than the position of the end part of each of the variable nozzle vanes on the side of the nozzle mount in the axial direction, it is possible to minimize a cross-sectional area of the swirl generating member, which occupies the flow passage extending from the scroll flow passage toward the turbine wheel. Thus, it is possible to enjoy an effect unique to the present disclosure that the decrease in turbine efficiency in the low opening state can be suppressed while keeping an influence on the flow passage in a high opening state small.

(2) In some embodiments, in the above configuration (1), the swirl generating member is formed into a protruding shape protruding toward the flow passage.

With the above configuration (2), with the swirl generating member of the protruding shape protruding from the nozzle plate toward the flow passage, it is possible to obtain, with a simple configuration, the radial inflow turbine capable of effectively forming the swirls on the side of the nozzle plate in the flow passage downstream of the swirl generating member.

(3) In some embodiments, in the above configuration (2), the swirl generating member has a height not greater than a quarter of the vane height of each of the plurality of variable nozzle vanes along a rotational axis direction of the turbine wheel.

With the above configuration (3), it is possible to minimize the cross-sectional area of the swirl generating member occupying the flow passage formed by the nozzle mount and the nozzle plate, in addition to being able to effectively form the swirls on the side of the nozzle plate in the flow passage downstream of the swirl generating member with the simple configuration. Thus, it is possible to effectively suppress the decrease in turbine efficiency in the low opening state while suppressing the influence on the flow passage in an opening (including the high opening state) other than the low opening state as much as possible.

(4) In some embodiments, in the above configuration (1), the swirl generating member is formed into a recessed shape retreating from the flow passage.

With the above configuration (4), it is possible to minimize the cross-sectional area of the swirl generating member occupying the flow passage formed by the nozzle mount and the nozzle plate, in addition to being able to obtain the same effect as the configuration in the above configuration (1). Thus, it is possible to effectively suppress the decrease in turbine efficiency in the low opening state while significantly suppressing the influence on the flow passage in an opening (including the high opening state) other than the low opening state.

(5) In some embodiments, in any one of the above configurations (1) to (4), provided that the number of the plurality of variable nozzle vanes is n, the swirl generating member is arranged in a range of ±(360°/n)/2 with reference to an intersection point between a radial position of the swirl generating member and an extended line of a chord of each of the plurality of variable nozzle vanes in a low opening state to upstream of the flow passage.

With the above configuration (5), it is possible to arrange the swirl generating member at a position where the generated swirls can appropriately act on each of the plurality of variable nozzle vanes in the low opening state. Thus, it is possible to reduce the clearance flows passing through the gap between the nozzle plate and each of the variable nozzle vanes more effectively.

(6) In some embodiments, in any one of the above configurations (1) to (5), the radial inflow turbine further includes a support pin swaged to the nozzle plate and disposed to protrude toward the flow passage. The swirl generating member is arranged on an outer side of the support pin in a radial direction of the turbine wheel.

In general, the support pin protruding on the side of the flow passage in the radial inflow turbine is mounted to be swaged to the nozzle plate after an end surface of the nozzle plate on the side of the flow passage is processed smoothly by, for example, milling. At this time, processing may be performed on a region including a position where the support pin is mounted in the radial direction of the turbine wheel. In this regard, with the above configuration (6), it is possible to enjoy the effect described in any one of the above configurations (1) to (5), without impairing the process of the end surface of the nozzle plate on the side of the flow passage when the support pin is arranged.

(7) In some embodiments, in any one of the above configurations (1) to (6), the swirl generating member is formed into an airfoil shape.

With the above configuration (7), with the swirl generating member formed into the airfoil shape, it is possible to easily generate swirls needed to suppress the clearance flow passing through the gap between the nozzle plate and each of the variable nozzle vanes, on the side of the nozzle plate of the downstream flow passage while suppressing an influence on flows of a working fluid passing through the flow passage.

(8) In some embodiments, in any one of the above configurations (1) to (7), the plurality of variable nozzle vanes are supported by the nozzle mount arranged on a hub side.

With the above configuration (8), it is possible to enjoy the effect described in any one of the above configurations (1) to (7), in the radial inflow turbine where the nozzle mount is arranged on the hub side.

(9) In some embodiments, in any one of the above configurations (1) to (7), the plurality of variable nozzle vanes are supported by the nozzle mount arranged on a shroud side.

With the above configuration (9), it is possible to enjoy the effect described in any one of the above configurations (1) to (7), in the radial inflow turbine where the nozzle mount is arranged on the shroud side.

(10) A turbocharger according to at least one embodiment of the present invention includes the radial inflow turbine according to any one of the above configurations (1) to (9), and a compressor driven by the radial inflow turbine.

With the above configuration (10), as described in the above configuration (1), it is possible to effectively suppress the decrease in turbine efficiency in the low opening state by effectively reducing the clearance flow passing through the gap between the nozzle plate and each of the variable nozzle vanes, and to obtain the turbocharger including the radial inflow turbine capable of suppressing the decrease in turbine efficiency in the low opening state while suppressing the influence on the flow passage in the high opening state to the minimum necessary.

Advantageous Effects

According to at least one embodiment of the present invention, it is possible to effectively suppress a decrease in turbine efficiency in a low opening state while suppressing an influence on a flow passage in a high opening state.

BRIEF DESCRIPTION OF DRAWINGS

FIG. 3A shows a state in which the swirl generating member is formed into a protruding shape toward a flow passage, and FIG. 3B shows a state in which the swirl generating member is formed into a recessed shape toward the flow passage.

DETAILED DESCRIPTION

Figure 1:
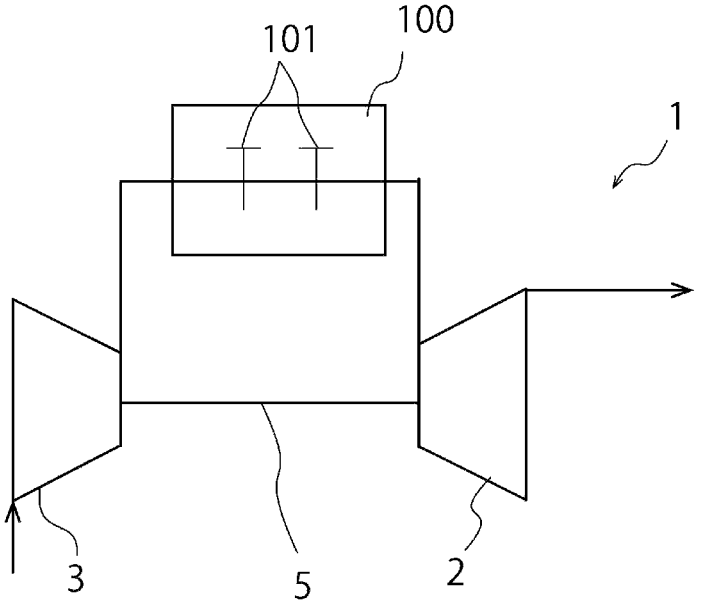
FIG. 1 is a schematic view showing the configuration of a turbocharger according to an embodiment.

Some embodiments of the present invention will be described below with reference to the accompanying drawings. It is intended, however, that unless particularly identified, dimensions, materials, shapes, relative positions and the like of components described in the embodiments or shown in the drawings shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, the expressions "comprising", "including", "having", "containing", and "constituting" one constitutional component are not exclusive expressions that exclude the presence of other constitutional components.

Figure 2:
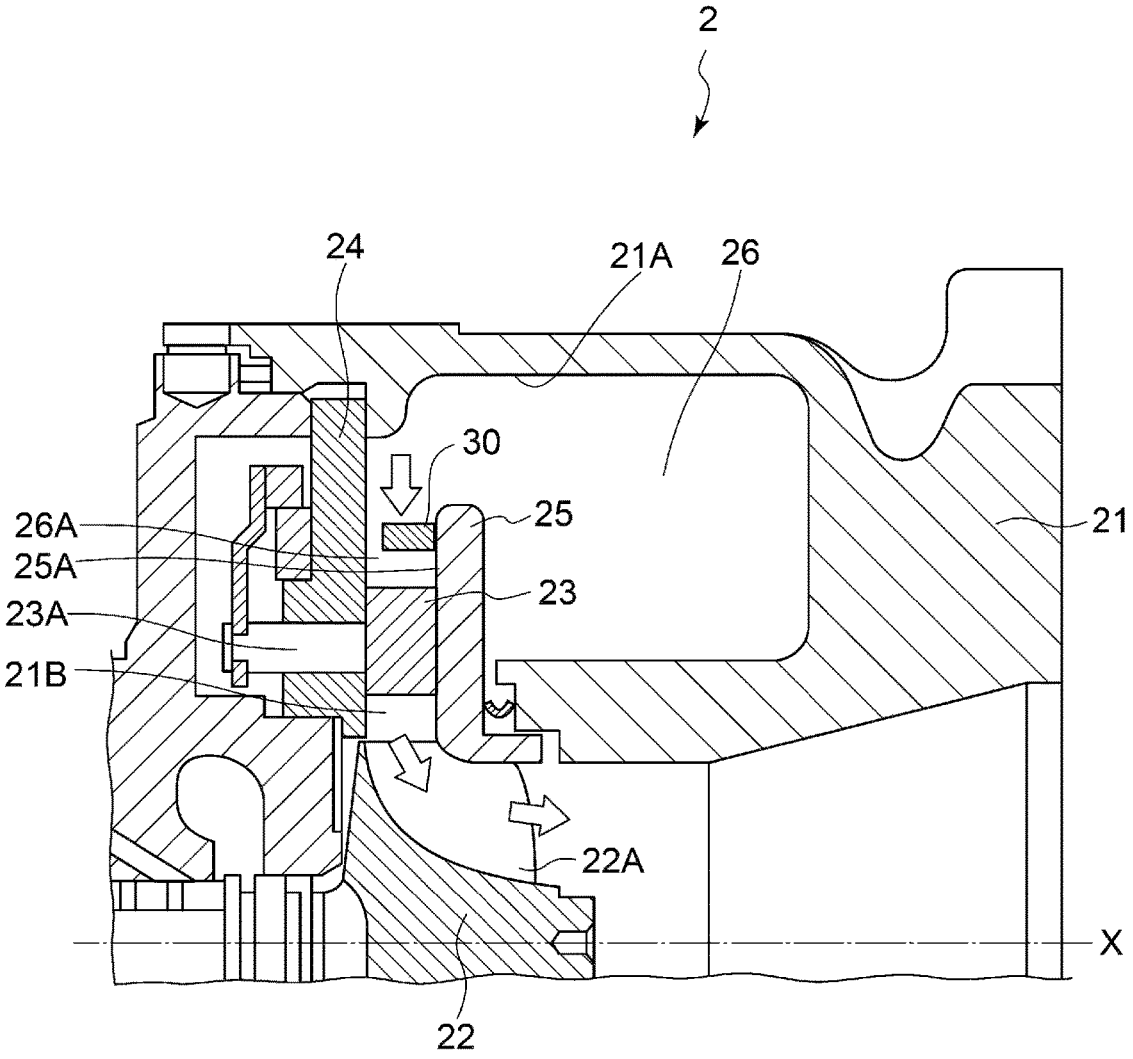
FIG. 2 is a schematic view of a radial inflow turbine according to an embodiment.
Figure 3A:
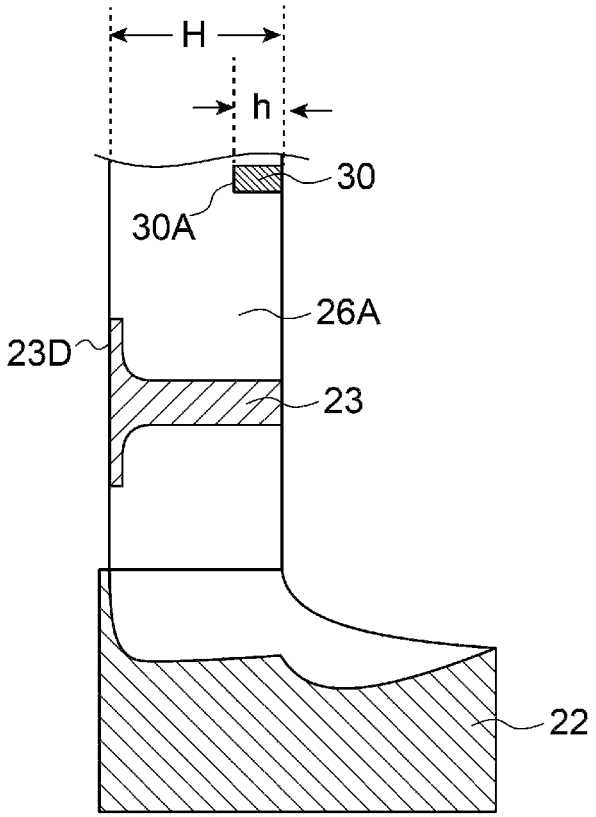
FIGS. 3A and 3B are views each giving a configuration example of a swirl generating member in an embodiment, where
Figure 3B:
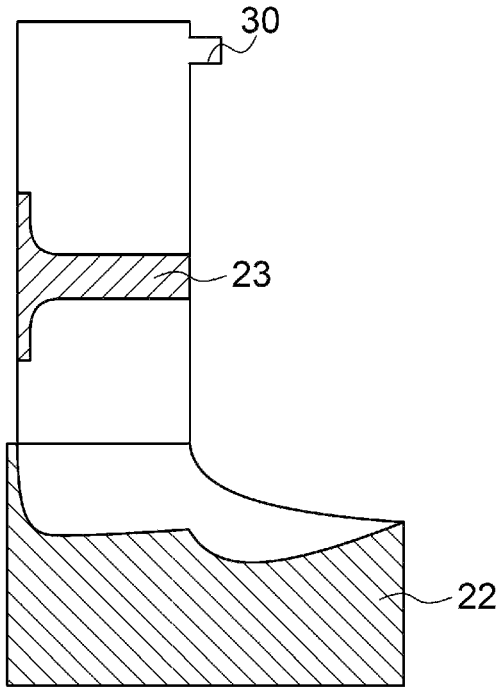

FIG. 1 is a schematic view showing the configuration of a turbocharger according to an embodiment. FIG. 2 is a schematic view of a radial inflow turbine according to an embodiment. FIGS. 3A and 3B are views each giving a configuration example of a swirl generating member in an embodiment, where FIG. 3A shows a state in which the swirl generating member is formed into a protruding shape toward a flow passage, and FIG. 3B shows a state in which the swirl generating member is formed into a recessed shape toward the flow passage.

As shown in FIGS. 1 and 2, a turbocharger 1 according to some embodiments includes a radial inflow turbine 2 and a compressor 3 driven by the radial inflow turbine 2.

The radial inflow turbine 2 is arranged on an exhaust side of an engine 100 including pistons 101 and a cylinder (not shown), and is rotary driven by using energy discharged from the engine 100. The compressor 3 is arranged on an air-supply side of the engine 100 and is coupled to the radial inflow turbine 2 to be coaxially rotatable via a turbine shaft 5 (rotational shaft). Then, when the radial inflow turbine 2 is rotated by using exhaust air from the engine 100 as a working fluid, the compressor 3 is rotated by using the rotational force, thereby supplying air (supercharging) into the engine 100.

As shown in FIG. 2, the radial inflow turbine 2 (turbine) according to an embodiment includes a turbine wheel 22 which is rotatable with the above-described turbine shaft 5 as a central shaft, and a housing 21 (turbine housing) storing the turbine wheel 22.

The turbine wheel 22 includes a plurality of rotor blades 22A formed radially along the circumferential direction of the rotational axis.

The housing 21 includes a scroll portion 21A and a bend portion 21B for turning a flow of the working fluid radially inward of the turbine wheel 22 from the scroll portion 21A to a direction along an axial direction X of the turbine wheel 22.

Then, the radial inflow turbine according to at least one embodiment of the present invention includes a scroll flow passage 26, the turbine wheel 22 disposed radially inward of the scroll flow passage 26, a plurality of variable nozzle vanes 23 disposed on a flow passage 26A extending from the scroll flow passage 26 toward the turbine wheel 22 at a radial position between the scroll flow passage 26 and the turbine wheel 22, a nozzle mount 24 rotatably supporting each of the plurality of variable nozzle vanes 23, a nozzle plate 25 arranged to face the nozzle mount 24 and forming the flow passage 26A with the nozzle mount 24, and a swirl generating member 30 disposed, radially outward of the plurality of variable nozzle vanes 23, on the nozzle plate 25 in a height range which is smaller than that of a vane height H (see FIG. 3A) of the variable nozzle vane 23.

The plurality of variable nozzle vanes 23 are arranged at intervals along the circumferential direction of the turbine wheel 22 in the flow passage 26A. Each of the plurality of variable nozzle vanes 23 is rotatably supported by the nozzle mount 24 via a rotating shaft 23A along the axial direction X, making it possible to adjust an opening between a low opening state (for example, see FIG. 4) and a high opening state (for example, see FIG. 5).

The swirl generating member 30 is arranged radially outward of the variable nozzle vane 23. A position of an end part 30A of the swirl generating member 30 on the side of the nozzle mount 24 is arranged to be farther away from the nozzle mount 24 than a position of an end part 23D of the variable nozzle vane 23 on the side of the nozzle mount 24 in the axial direction X.

In the radial inflow turbine 2 including the variable nozzle vane 23, it is known that turbine efficiency may be decreased by so-called clearance flows F2 passing through a gap between the nozzle mount 24 and the nozzle plate 25, and an axial end surface 23C of the variable nozzle vane 23 in the low opening state. The nozzle mount 24 and the nozzle plate 25 form the flow passage 26A extending from the scroll flow passage 26 toward the turbine wheel 22. The variable nozzle vane 23 is arranged between the nozzle mount 24 and the nozzle plate 25. In particular, in a case in which the variable nozzle vane 23 is supported in a cantilever fashion via the rotating shaft 23A, the more clearance flows F2 flow into a gap between the variable nozzle vane 23 and the nozzle plate 25 where the rotating shaft 23A does not exist, as compared with a gap between the variable nozzle vane 23 and the nozzle mount 24 where the rotating shaft 23A exists.

Figure 6A:
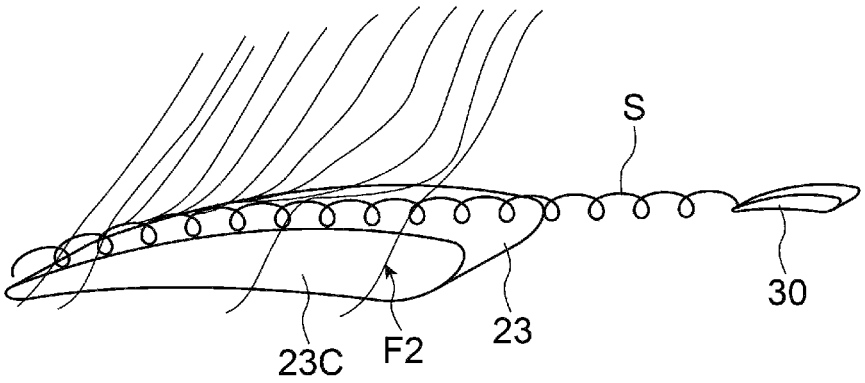
FIGS. 6A and 6B are views each illustrating clearance flows flowing through an axial end surface of the nozzle vane in an embodiment.
Figure 6B:
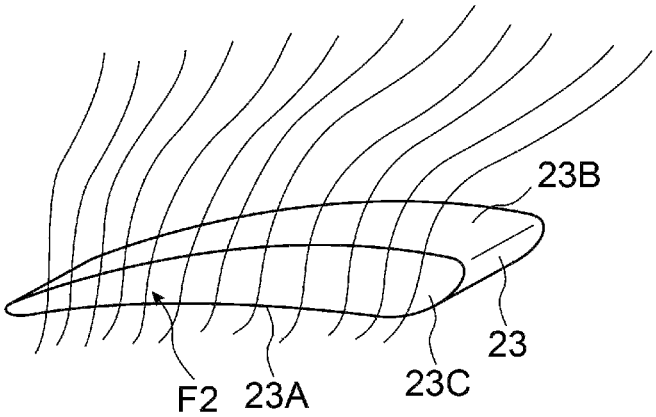
Figure 7:
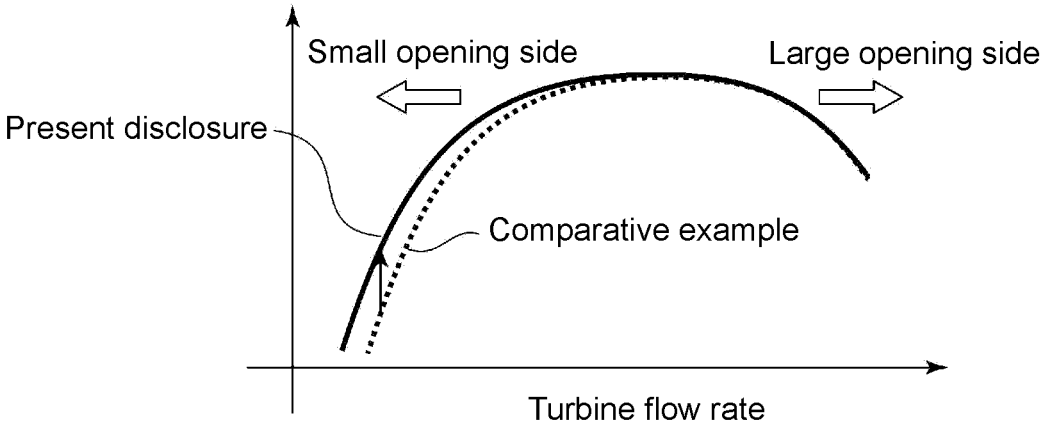
FIG. 7 is a schematic graph showing the relationships between a turbine flow rate and an output of the radial inflow turbine and a comparative example, respectively, according to an embodiment.

In this regard, according to the above configuration, with the swirl generating member 30 disposed on the nozzle plate 25 on the outer side of the variable nozzle vane 23, that is, upstream of the flow passage 26A in the radial direction of the turbine wheel 22, for example, swirls S are formed on the side of the nozzle plate 25 as shown in FIG. 6A in the flow passage 26A on the inner side of the swirl generating member 30, that is, downstream of the flow passage 26A in the above-described radial direction. With these swirls S, it is possible to reduce a pressure difference between a pressure side (pressure surface) 23A and a suction side 23B of the variable nozzle vane 23. Thus, it is possible to effectively reduce the clearance flows F2 passing through the gap between the variable nozzle vane 23 and the nozzle plate 25, making it possible to effectively suppress the decrease in turbine efficiency in the low opening state, as compared with a comparative example (for example, see FIG. 6B) without the swirl generating member 30. Furthermore, since the position of the end part 30A of the swirl generating member 30 on the side of the nozzle mount 24 is farther away from the nozzle mount 24 than the position of the end part 23D of the variable nozzle vane 23 on the side of the nozzle mount 24 in the axial direction X, it is possible to minimize a cross-sectional area of the swirl generating member 30, which occupies the flow passage 26A extending from the scroll flow passage 26 toward the turbine wheel 22. Thus, it is possible to enjoy an effect unique to the present disclosure that the decrease in turbine efficiency in the low opening state can be suppressed (for example, see FIG. 7) while keeping an influence on the flow passage 26A in the high opening state small.

In some embodiments, in the above configuration, the swirl generating member 30 may be formed into a protruding shape protruding toward the flow passage 26A (for example, see FIGS. 2 and 3A). That is, the swirl generating member 30 can be configured to protrude from the nozzle plate 25 to the flow passage 26A and to occupy a predetermined cross-section in the flow passage 26A. A shape in the case of the protruding shape is not particularly limited, and may be any shape capable of forming appropriate swirls on the side of the nozzle plate 25 in the flow passage 26A. If thus configured, with the swirl generating member 30 of the protruding shape protruding from the nozzle plate 25 toward the flow passage 26A, it is possible to obtain, with a simple configuration, the radial inflow turbine 2 capable of effectively forming the swirls S on the side of the nozzle plate 25 in the flow passage downstream of the swirl generating member 30.

In some embodiments, in the above configuration, the swirl generating member 30 may have a height h which is not greater than a quarter of the vane height H of the variable nozzle vane 23 along the rotational axis X direction of the turbine wheel 22 (see FIG. 3A). Furthermore, the swirl generating member 30 may be formed to have a height about one fifth of the height of the variable nozzle vane 23 along the rotational axis X direction of the turbine wheel 22.

With the above configuration, it is possible to minimize the cross-sectional area of the swirl generating member 30 occupying the flow passage 26A formed by the nozzle mount 24 and the nozzle plate 25, in addition to being able to effectively form the swirls S on the side of the nozzle plate 25 in the flow passage 26A downstream of the swirl generating member 30 with the simple configuration. Thus, it is possible to effectively suppress the decrease in turbine efficiency in the low opening state while suppressing the influence on the flow passage 26A in an opening (including the high opening state) other than the low opening state as much as possible.

In some embodiments, in the above configuration, the swirl generating member 30 may be formed into a recessed shape retreating from the flow passage 26A (for example, see FIG. 3B). A shape in the case of the recessed shape is not particularly limited, and may be any shape capable of forming appropriate swirls on the side of the nozzle plate 25 in the flow passage 26A. If thus configured, it is possible to minimize the cross-sectional area of the swirl generating member 30 occupying the flow passage 26A formed by the nozzle mount 24 and the nozzle plate 25, in addition to being able to obtain the same effect as the configuration described in any of the above-described embodiments. Thus, it is possible to effectively suppress the decrease in turbine efficiency in the low opening state while suppressing the influence on the flow passage 26A in the opening (including the high opening state) other than the low opening state as much as possible.

Figure 4:
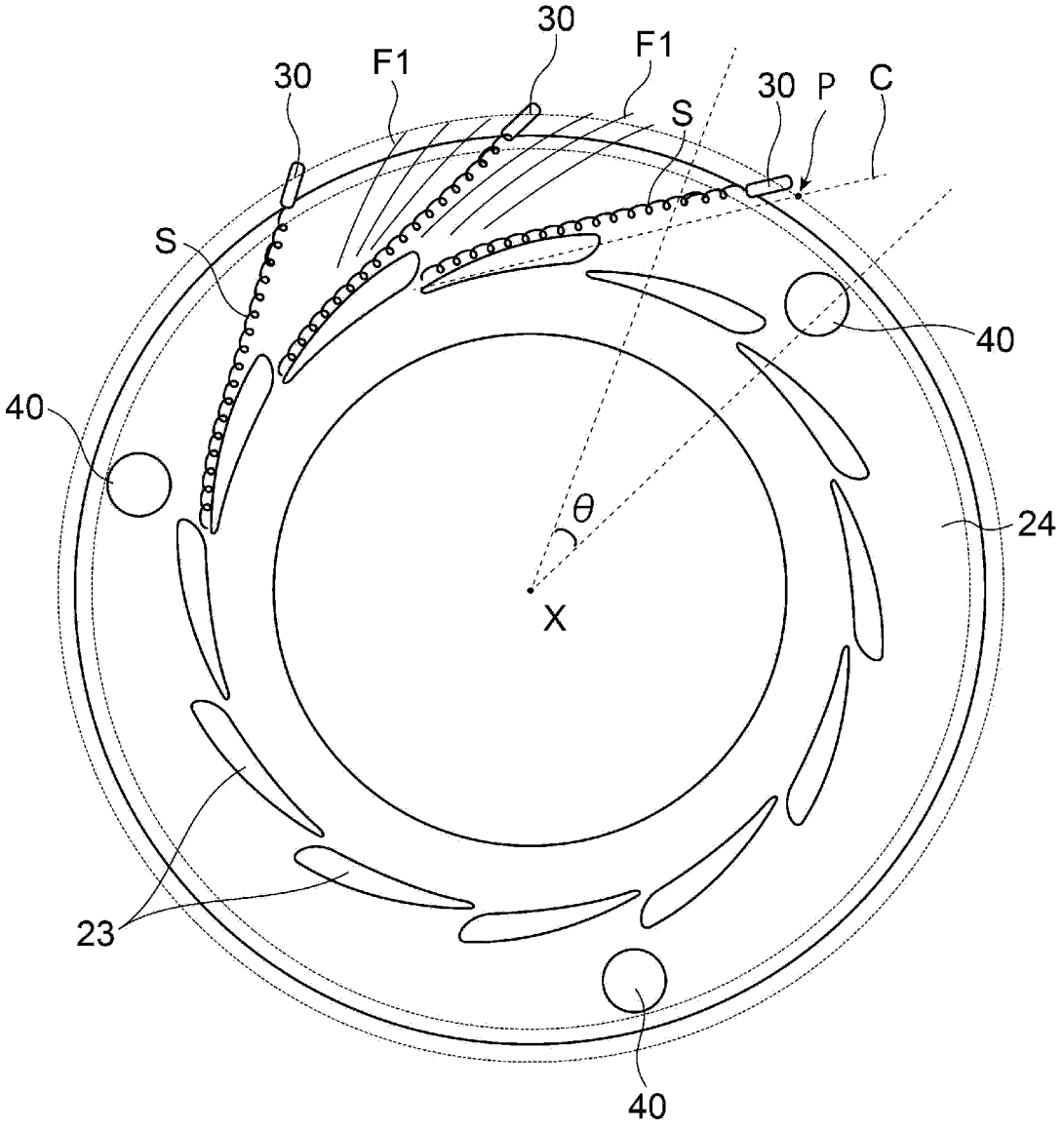
FIG. 4 is a schematic view of a nozzle vane (low opening state) in an embodiment.
Figure 5:
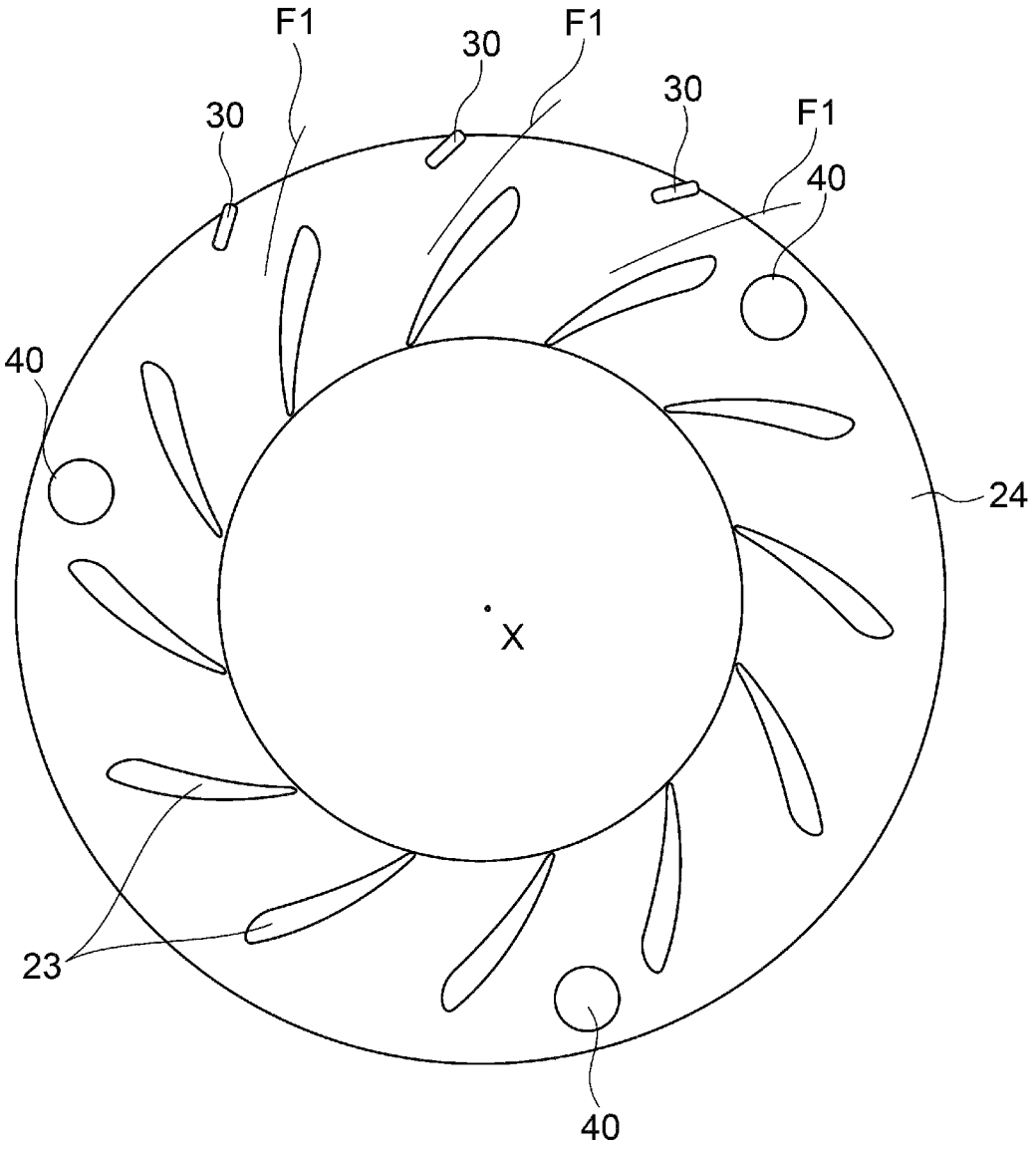
FIG. 5 is a schematic view of the nozzle vane (high opening state) in an embodiment.

As shown in FIG. 4 as a non-limited example, in some embodiments, in the configuration described in any one of the above-described embodiments, provided that the number of variable nozzle vanes 23 is n, each of the swirl generating members 30 may be arranged in the range of $\pm(360°/n)/2$ with reference to an intersection point P between a radial position of the swirl generating member 30 and an extended line C of a chord of a corresponding one of the variable nozzle vanes 23 in the low opening state to upstream of the flow passage 26A. That is, the swirl generating members 30 may be arranged in accordance with the number of variable nozzle vanes 23, and at least one swirl generating member 30 may be arranged within the range of an angle θ ($\theta=360°/n$) shown in FIG. 4.

With the above configuration, it is possible to arrange the swirl generating member 30 at a position where the generated swirls S can appropriately act on each of the plurality of variable nozzle vanes 23 in the low opening state. Thus, it is possible to reduce the clearance flows F2 passing through the gap between the nozzle plate 25 and each of the variable nozzle vanes 23 more effectively.

In some embodiments, in the configuration described in any one of the above-described embodiments, the radial inflow turbine 2 may further include support pins 40 swaged to the nozzle plate 25 and disposed to protrude toward the flow passage 26A, and the swirl generating members 30 may be arranged on the outer side of the support pins 40 in the radial direction of the turbine wheel 22 (for example, see FIG. 4).

In general, the support pins 40 protruding on the side of the flow passage 26A in the radial inflow turbine 2 are mounted to be swaged to the nozzle plate 25 after an end surface 25A of the nozzle plate 25 on the side of the flow passage 26A is processed smoothly by, for example, milling. At this time, processing may be performed on a region including positions where the support pins 40 are mounted in the radial direction of the turbine wheel 22. In this regard, with the above configuration, it is possible to enjoy the effect described in any one of the above-described embodiments, without influencing the process of the end surface 25A of the nozzle plate 25 on the side of the flow passage 26A when the support pins 40 are arranged.

In some embodiments, in the configuration described in any one of the above-described embodiments, the swirl generating member 30 may be formed into an airfoil shape (for example, see FIG. 6A). If thus configured, with the swirl generating member 30 formed into the airfoil shape, it is possible to easily generate swirls needed to suppress the clearance flows F2 passing through the gap between the variable nozzle vane 23 and the nozzle plate 25, on the side of the nozzle plate 25 of the downstream flow passage 26A while suppressing an influence on flows of a working fluid F1 passing through the flow passage 26A.

In some embodiments, in the configuration described in any one of the above-described embodiments, the above-described variable nozzle vane 23 may be supported by the nozzle mount 24 arranged on a hub side (for example, see FIGS. 2, 3A, and 3B).

If thus configured, it is possible to enjoy the effect described in any one of the above-described embodiments, in the radial inflow turbine 2 where the nozzle mount 24 is arranged on the hub side.

Figure 8:
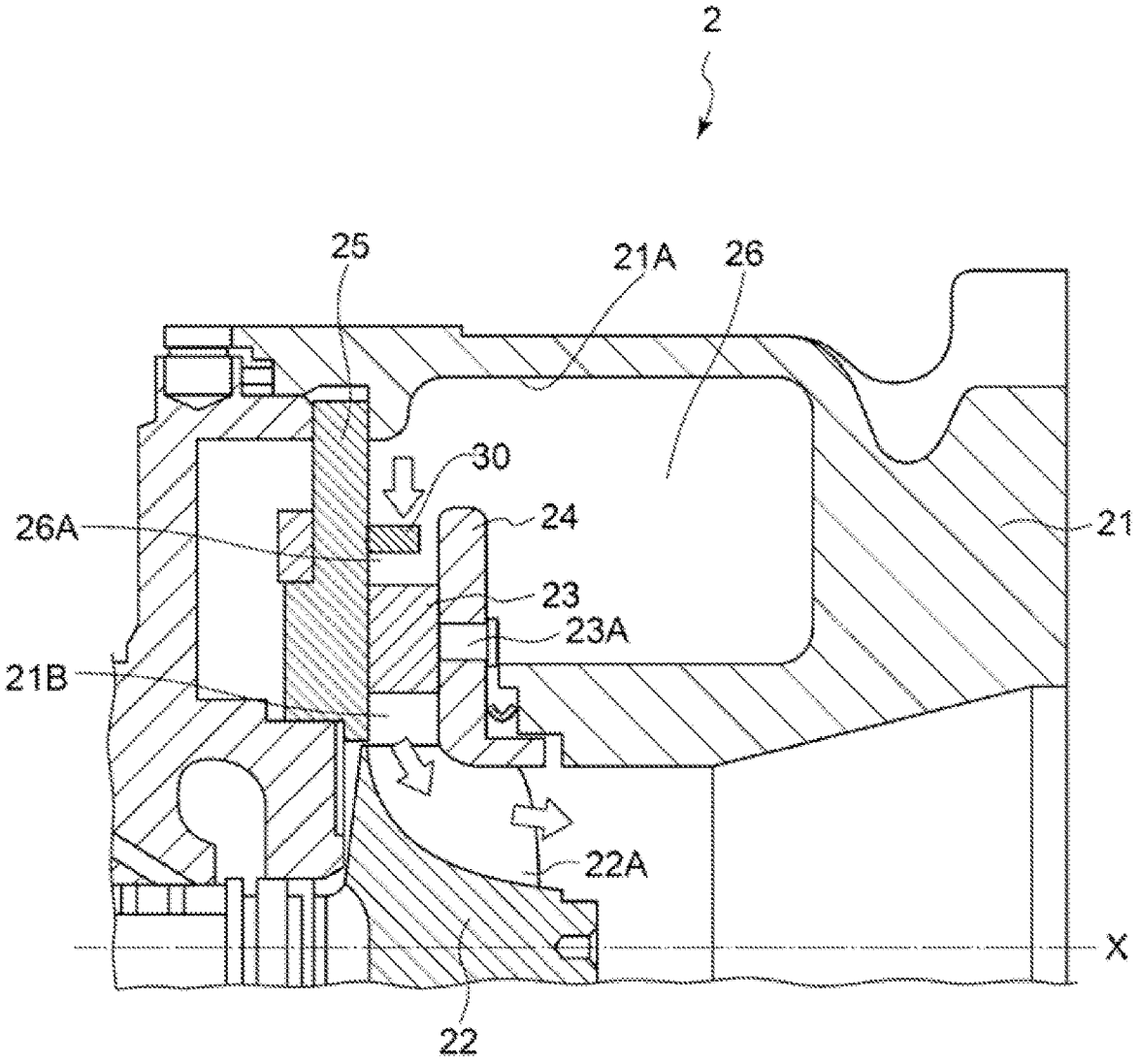
FIG. 8 is a schematic view showing the arrangement of the nozzle vane and the swirl generating member according to another embodiment.

In some embodiments, in the configuration described in any one of the above-described embodiments, the variable nozzle vane 23 may be supported by the nozzle mount 24 arranged on a shroud side, and the swirl generating member 30 may be disposed on the hub side (for example, see FIG. 8). If thus configured, it is possible to enjoy the effect described in any one of the above-described embodiments, in the radial inflow turbine 2 where the nozzle mount 24 is arranged on the shroud side.

Then, as described in some embodiments of the present disclosure, it is possible to effectively suppress the decrease in turbine efficiency in the low opening state by effectively reducing the clearance flows F2 passing through the gap between the variable nozzle vane 23 and the nozzle plate 25, and to obtain the turbocharger 1 including the radial inflow turbine 2 capable of suppressing the decrease in turbine efficiency in the low opening state while suppressing the influence on the flow passage 26A in the high opening state to the minimum necessary.

According to some embodiments of the present disclosure described above, it is possible to effectively suppress the decrease in turbine efficiency in the low opening state while suppressing the influence on the flow passage in the high opening state.

Embodiments of the present invention were described in detail above, but the present invention is not limited thereto, and also includes an embodiment obtained by modifying the above-described embodiments and an embodiment obtained by combining these embodiments as appropriate.

REFERENCE SIGNS LIST

1 Turbocharger
2 Radial inflow turbine
3 Compressor
5 Turbine shaft
21 Housing
21A Scroll portion
21B Bend portion
22 Turbine wheel
22A Rotor blade (impeller)
23 Variable nozzle vane
23A Pressure side
23B Suction side
23C Axial end surface
24 Nozzle mount
25 Nozzle plate
26 Scroll flow passage
26A Flow passage
30 Swirl generating member
30A End part on side of nozzle mount
40 Support pin
100 Engine (internal combustion engine)
101 Piston
C Extended line
P Intersection point
F1 Working fluid (exhaust gas)
F2 Clearance flow
H Vane height
S Swirl
X Axial direction

The invention claimed is:

1. A radial inflow turbine comprising:
a scroll flow passage;
a turbine wheel disposed radially inward of the scroll flow passage;
a plurality of variable nozzle vanes disposed on a flow passage extending from the scroll flow passage toward the turbine wheel, at a radial position between the scroll flow passage and the turbine wheel;
a nozzle mount rotatably supporting each of the plurality of variable nozzle vanes;
a nozzle plate arranged to face the nozzle mount and forming the flow passage with the nozzle mount; and
a protrusion disposed radially outward of the plurality of variable nozzle vanes on the nozzle plate, the protrusion having a height which is smaller than that of a vane height of each of the plurality of variable nozzle vanes,
wherein the protrusion has a first end part facing the nozzle mount and each of the plurality of variable nozzle vanes has a second end part facing the nozzle mount, the first end part farther away from the nozzle mount than the second end part in an axial direction of the radial inflow turbine.

2. The radial inflow turbine according to claim 1,
wherein the protrusion is formed to protrude toward the flow passage.

3. The radial inflow turbine according to claim 2,
wherein the protrusion has a height not greater than a quarter of the vane height of each of the plurality of variable nozzle vanes along a rotational axis direction of the turbine wheel.

4. The radial inflow turbine according to claim 1,
wherein, provided that the number of the plurality of variable nozzle vanes is n, the protrusion is arranged in a range of $\pm(360°/n)/2$ with reference to an intersection point between a radial position of the protrusion and an extended line of a chord of each of the plurality of variable nozzle vanes in a low opening state to upstream of the flow passage.

5. The radial inflow turbine according to claim 1, further comprising a support pin swaged to the nozzle plate and disposed to protrude toward the flow passage,
wherein the protrusion is arranged on an outer side of the support pin in a radial direction of the turbine wheel.

6. The radial inflow turbine according to claim 1,
wherein the protrusion is formed into an airfoil shape.

7. The radial inflow turbine according to claim 1,
wherein the plurality of variable nozzle vanes are supported by the nozzle mount arranged on a hub side.

8. The radial inflow turbine according to claim 1,
wherein the plurality of variable nozzle vanes are supported by the nozzle mount arranged on a shroud side.

9. A turbocharger comprising:
the radial inflow turbine according to claim 1; and
a compressor driven by the radial inflow turbine.

10. A radial inflow turbine comprising:
a scroll flow passage;
a turbine wheel disposed radially inward of the scroll flow passage;
a plurality of variable nozzle vanes disposed on a flow passage extending from the scroll flow passage toward the turbine wheel, at a radial position between the scroll flow passage and the turbine wheel;
a nozzle mount rotatably supporting each of the plurality of variable nozzle vanes;
a nozzle plate arranged to face the nozzle mount and forming the flow passage with the nozzle mount; and
a recess disposed radially outward of the plurality of variable nozzle vanes on the nozzle plate to retract from the flow passage, the recess having a depth which is smaller than that of a vane height of each of the plurality of variable nozzle vanes.

11. A turbocharger comprising:
the radial inflow turbine according to claim 10; and
a compressor driven by the radial inflow turbine.

* * * * *